US006225751B1

(12) United States Patent
Komatsu

(10) Patent No.: US 6,225,751 B1
(45) Date of Patent: May 1, 2001

(54) FLUORESCENT LAMP DRIVE CIRCUIT OF AN IMAGE FORMATION APPARATUS

(75) Inventor: Shunichi Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/110,026

(22) Filed: Jul. 2, 1998

(30) Foreign Application Priority Data

Jul. 4, 1997 (JP) ..... 9-193392

(51) Int. Cl.[7] ..... H05B 37/00

(52) U.S. Cl. ..... 315/209 R; 315/219; 315/224; 315/307

(58) Field of Search ..... 315/219, 209 R, 315/307, 224, 157, 158, 159

(56) References Cited

U.S. PATENT DOCUMENTS 4,998,046 3/1991 Lester ..... 315/209 R
5,331,253 * 7/1994 Counts ..... 315/209 R

FOREIGN PATENT DOCUMENTS 4437204 3/1996 (DE) .
0650313 4/1995 (EP) .
2316246 2/1998 (GB) .

* cited by examiner

*Primary Examiner*—David Vu
(74) *Attorney, Agent, or Firm*—Fitzpatrick, Cella, Harper & Scinto

(57) ABSTRACT

A copy machine comprises a fluorescent lamp inverter circuit for supplying a voltage necessary to light on a fluorescent lamp for exposing an original, an inverter control circuit for outputting an inverter drive signal of a first frequency to control the fluorescent lamp inverter circuit, a light modulation control circuit for outputting a light modulation drive signal of a second frequency to control a current flowing in the fluorescent lamp, and a synchronization circuit for synchronizing the inverter drive signal and the light modulation drive signal with each other by using a clock division circuit and a phase-locked loop (PLL) circuit. Thus, unevenness in exposing of the original is eliminated, thereby improving image quality.

45 Claims, 6 Drawing Sheets

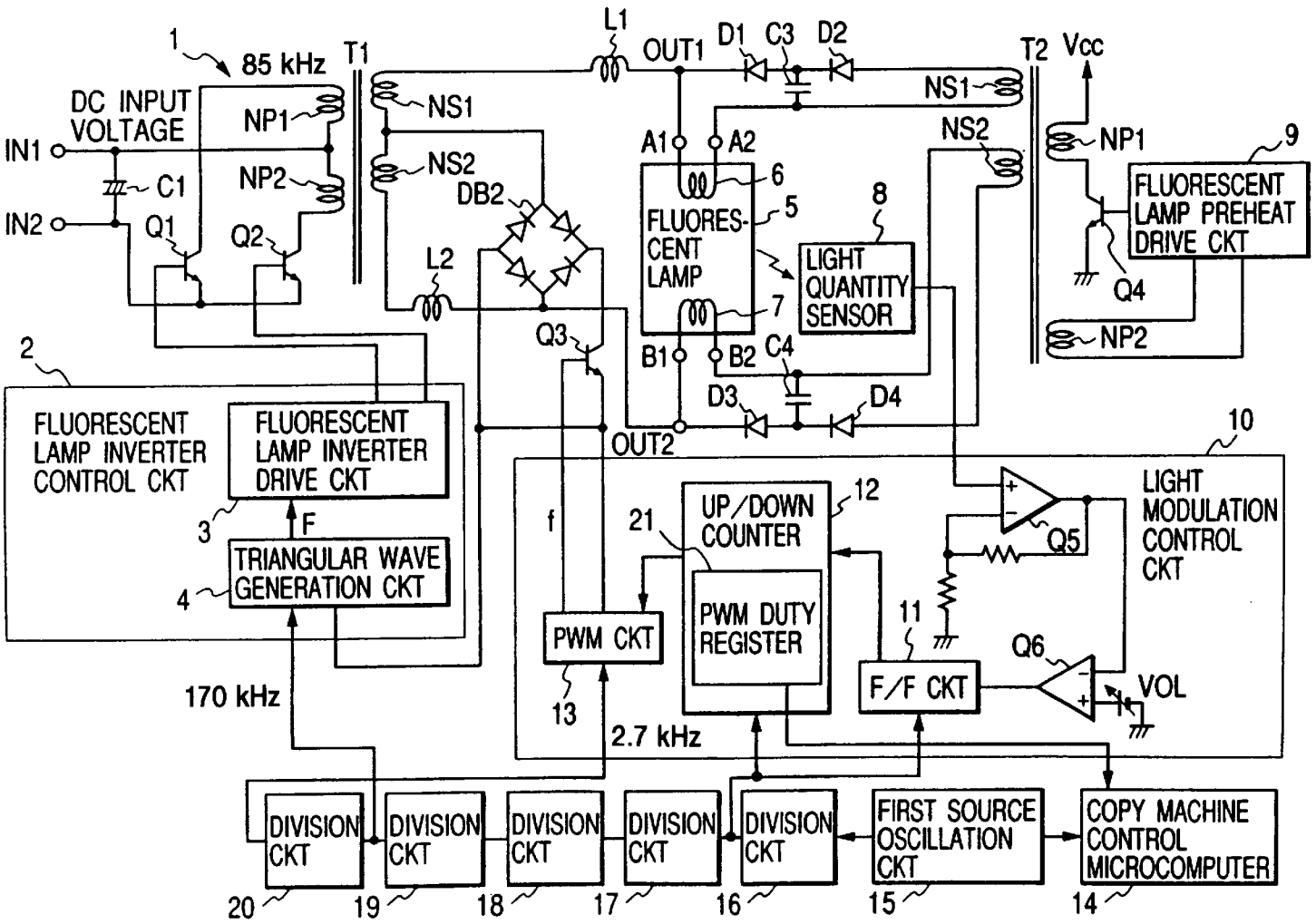
FIG. 1
FLUORESCENT LAMP PREHEAT DRIVE CKT
9
NP1
NP2
Q4
Vcc
T2
NS1
NS2
LIGHT QUANTITY SENSOR
8
D2
C3
D1
D4
C4
D3
A2
A1
B2
B1
FLUORES-CENT LAMP
5
6
7
OUT1
OUT2
L1
L2
Q3
DB2
T1
85 kHz
NP1
NP2
Q2
Q1
C1
DC INPUT VOLTAGE
IN1
IN2
1
2
FLUORESCENT LAMP INVERTER CONTROL CKT
FLUORESCENT LAMP INVERTER DRIVE CKT
3
F
TRIANGULAR WAVE GENERATION CKT
4
170 kHz
LIGHT MODULATION CONTROL CKT
10
Q5
Q6
VOL
F/F CKT
11
UP/DOWN COUNTER
12
PWM DUTY REGISTER
21
PWM CKT
13
f
2.7 kHz
COPY MACHINE CONTROL MICROCOMPUTER
14
FIRST SOURCE OSCILLATION CKT
15
DIVISION CKT
16
DIVISION CKT
17
DIVISION CKT
18
DIVISION CKT
19
DIVISION CKT
20

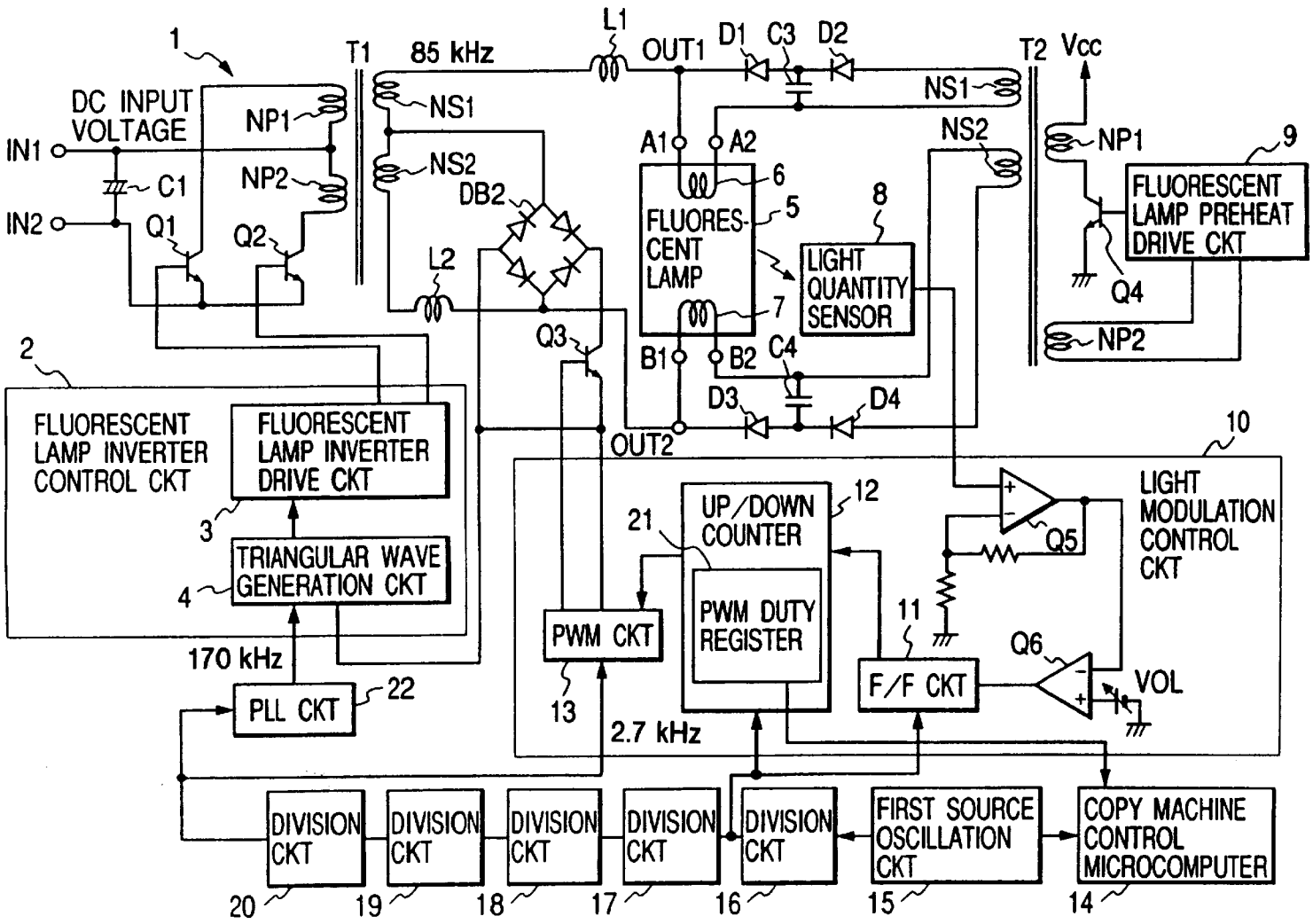
FIG. 2
FLUORESCENT LAMP PREHEAT DRIVE CKT
9
NP1
Q4
NP2
Vcc
T2
NS1
NS2
LIGHT QUANTITY SENSOR
8
D2
C3
D1
OUT1
L1
A2
A1
6
5
FLUORESCENT LAMP
7
B2
B1
C4
D4
D3
OUT2
Q3
DB2
L2
85 kHz
T1
NP1
NP2
Q2
Q1
C1
DC INPUT VOLTAGE
IN1
IN2
1
FLUORESCENT LAMP INVERTER CONTROL CKT
2
FLUORESCENT LAMP INVERTER DRIVE CKT
3
TRIANGULAR WAVE GENERATION CKT
4
170 kHz
PLL CKT
22
LIGHT MODULATION CONTROL CKT
10
Q5
Q6
VOL
F/F CKT
11
UP/DOWN COUNTER
12
PWM DUTY REGISTER
21
PWM CKT
13
2.7 kHz
COPY MACHINE CONTROL MICROCOMPUTER
14
FIRST SOURCE OSCILLATION CKT
15
DIVISION CKT
16
DIVISION CKT
17
DIVISION CKT
18
DIVISION CKT
19
DIVISION CKT
20

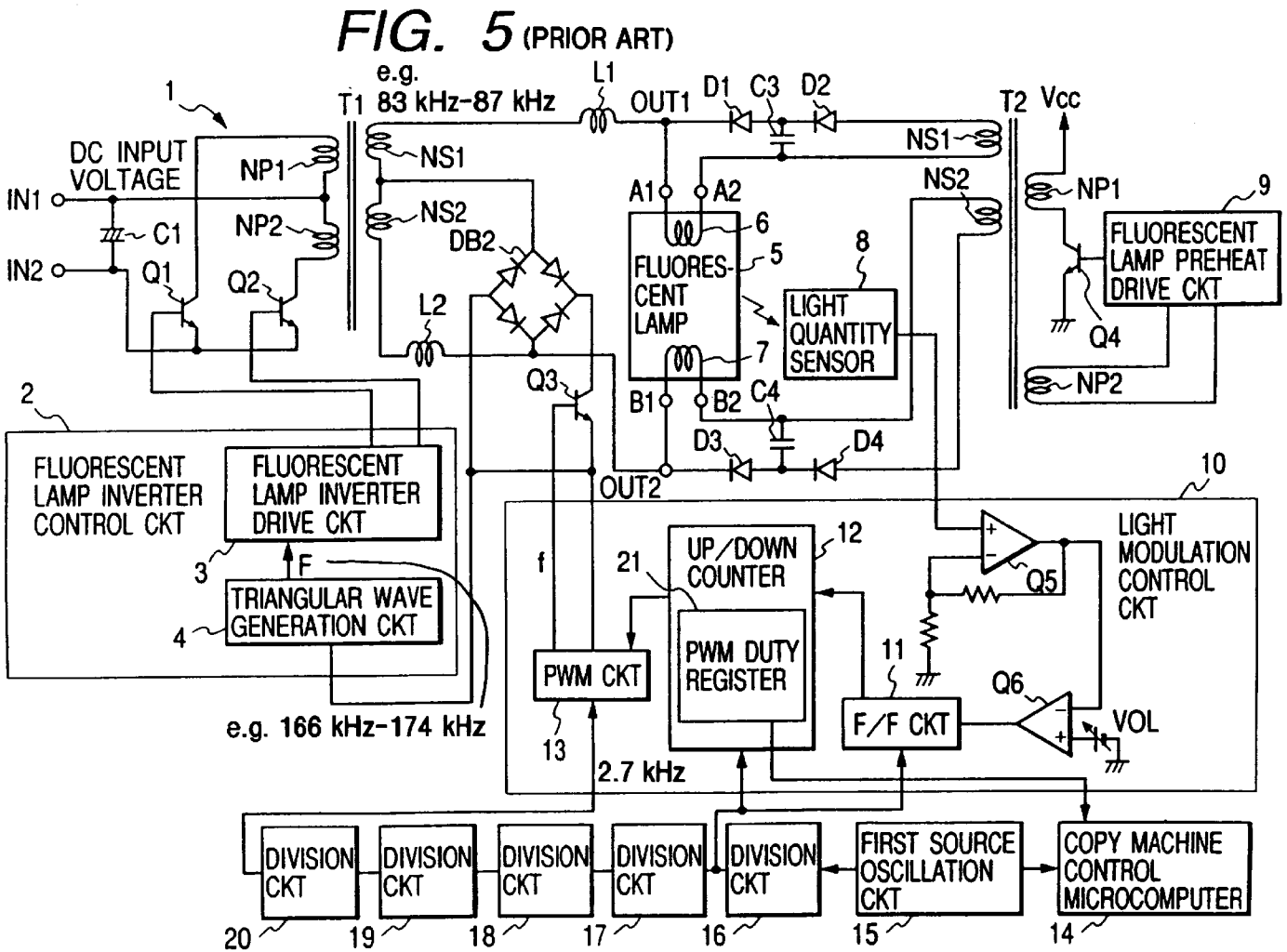
FIG. 5 (PRIOR ART)
FLUORESCENT LAMP PREHEAT DRIVE CKT
LIGHT MODULATION CONTROL CKT
COPY MACHINE CONTROL MICROCOMPUTER
FIRST SOURCE OSCILLATION CKT
DIVISION CKT
LIGHT QUANTITY SENSOR
FLUORESCENT LAMP
UP/DOWN COUNTER
PWM DUTY REGISTER
F/F CKT
PWM CKT
FLUORESCENT LAMP INVERTER DRIVE CKT
TRIANGULAR WAVE GENERATION CKT
FLUORESCENT LAMP INVERTER CONTROL CKT
DC INPUT VOLTAGE
e.g. 83 kHz-87 kHz
e.g. 166 kHz-174 kHz
2.7 kHz
Vcc
VOL 83kHz
85kHz
87kHz
0
2.7kHz
0
0
85kHz
0
0
0
0
0

FLUORESCENT LAMP DRIVE CIRCUIT OF AN IMAGE FORMATION APPARATUS

BACKGROUND OF THE INVENTION

1. Field of the Invention

The present invention relates to a drive circuit for a lamp, and more particularly to inverter driving of a fluorescent lamp.

2. Related Background Art

FIG. 5 is a diagram showing the structure of a conventional fluorescent lamp drive circuit, and FIGS. 6A to 6G are timing charts showing signal waveforms of the conventional fluorescent lamp drive circuit shown in FIG. 5 and a fluorescent lamp drive circuit according to the present invention.

In FIG. 5, the fluorescent lamp drive circuit is the fluorescent lamp drive circuit of an image formation apparatus, e.g., a copy machine. The fluorescent lamp drive circuit is composed of a fluorescent lamp power supply circuit 1, a fluorescent lamp inverter control circuit 2 for controlling a fluorescent lamp inverter of the circuit 1, a fluorescent lamp 5 for exposing an original, a light quantity sensor 8 for detecting a light quantity of the lamp 5, a preheating transformer T2 for preheating filaments 6 and 7 of the lamp 5, a light modulation control circuit 10 of the lamp 5, a microcomputer 14 (to be referred as copy machine control microcomputer hereinafter) for controlling the copy machine acting as the image formation apparatus, a first source oscillation circuit 15, division circuits 16 to 20 for frequency-dividing a clock pulse generated from the circuit 15, and the like.

A fluorescent lamp inverter drive signal of a frequency F which is output from a triangular wave generation circuit 4 of the fluorescent lamp inverter control circuit 2 in the fluorescent lamp drive circuit structured as above and then supplied to a fluorescent lamp inverter drive circuit 3 is shown in FIG. 6A. A fluorescent lamp light modulation drive signal of a frequency f which is output from a pulse width modulation (PWM) circuit 13 of the light modulation control circuit 10 and then supplied to a base of a switching transistor Q3 of a diode bridge DB2 is shown in FIG. 6B. A current waveform flowing in the filaments 6 and 7 of the fluorescent lamp 5 is shown in FIG. 6G.

Conventionally, the fluorescent lamp inverter drive signal of the frequency F is often generated from a charge pump circuit by using an analog control IC (e.g., $\mu$PC494 or the like). For this reason, blurring of a setting frequency or a frequency temperature characteristic is several percent or so, and a drift happens in the unit of several seconds or several minutes after the power supply of the copy machine is turned on. FIG. 6A shows an example that the frequency F of the fluorescent lamp inverter drive signal is drifted in the order of 83 kHz→85 kHz→87 kHz.

On the other hand, since the fluorescent lamp light modulation drive signal of the frequency f concerns a flip-flop circuit 11, an up/down counter 12, the PWM circuit 13, the copy machine control microcomputer 14, a not-shown CCD drive circuit and the like, such the signal is often generated by appropriately frequency-dividing the clock pulse generated from the first source oscillation circuit 15 with the division circuits 16 to 20. For this reason, as compared with the frequency F of the fluorescent lamp inverter drive signal, since there is hardly blurring of a setting frequency or a frequency temperature characteristic in the frequency f of the fluorescent lamp light modulation drive signal, such the setting frequency and the frequency temperature characteristic are constant.

FIG. 6G shows the current waveform which is obtained by synthesizing (i.e., AND) the fluorescent lamp inverter drive signal in FIG. 6A and the fluorescent lamp light modulation drive signal in FIG. 6B and flows in the filaments 6 and 7 of the lamp 5. It should be noted that the frequency F of the fluorescent lamp inverter drive signal shown in FIG. 6A is asynchronous with the frequency f of the fluorescent lamp light modulation drive signal shown in FIG. 6B. Further, since the frequency F drifts as described above, the number of pulses of the frequency 85 kHz of the fluorescent lamp inverter drive signal included in each one period (2.7 kHz) of the fluorescent lamp light modulation drive signal differs in each period as shown in FIG. 6G.

In the above-described conventional fluorescent lamp drive circuit, however, there are following drawbacks. That is, since the frequency F of the fluorescent lamp inverter drive signal and the frequency f of the fluorescent lamp light modulation drive signal may produce a beat, a substantial lighting current of the lamp 5 varies, whereby the light quantity also varies.

In addition, if a value of $|F-f\times N|=D$ (N: integer) is being within a predetermined range, unevenness or nonuniformity according to the above beat appears in a sub-scan direction on an image. For example, if it is assumed that the frequency f of the fluorescent lamp light modulation drive signal is 2.7 kHz and the frequency F of the fluorescent lamp inverter drive signal is 85 kHz to 87 kHz, a 32 integral multiple of 2.7 kHz is 2.7 kHz×32=86.4 kHz.

Here, if the frequency F is 86.3 kHz, the unevenness of 86.4 kHz−86.3 kHz=100 Hz appears on the image; if the frequency F is 86.41 kHz, the unevenness of 86.41 kHz−86.4 kHz=10 Hz appears on the image; and if the frequency F is 86.5 kHz, the unevenness/of 86.5 kHz−86.4 kHz=100 Hz appears on the image.

Basically, even if the frequency F has any value, the beat itself is produced. For example, if the frequency F is 85.9 kHz, the unevenness of 86.4 kHz−85.9 kHz=500 Hz appears; and if the frequency F is 86.9 kHz, the unevenness of 86.9 kHz−86.4 kHz=500 Hz appears.

However, if the frequency of the unevenness becomes equal to or larger than a predetermined value (e.g., ≧500 Hz), the unevenness on the image becomes invisible for human eyes. That is, in a case where the value of the frequency F and the value of the frequency f×N (N: integer) are closely coincided (i.e., synchronized) with each other, or in a case where these values are apparent from each other by a predetermined value or more, any unevenness does not appear on the image. On the other hand, if these values are not slightly coincided with each other, the unevenness corresponding to the difference between the frequencies not coincided appears on the image.

SUMMARY OF THE INVENTION

An object of the present invention is to provide a lamp drive circuit which eliminates the above-described drawbacks.

An another object of the present invention is to provide a fluorescent lamp drive circuit which prevents unevenness in a sub-scan direction on an image appeared due to a beat produced by a fluorescent lamp inverter drive signal and a fluorescent lamp light modulation drive signal by synchronizing these two signals, and to provide an image exposure apparatus in which such the fluorescent lamp drive circuit is used.

A still another object of the present invention will be apparent from the detailed description and the appended claims in conjunction with the accompanying drawings.

BRIEF DESCRIPTION OF THE DRAWINGS

FIG. 1 is a diagram showing the structure of a fluorescent lamp drive circuit according to a first embodiment of the present invention;

FIG. 2 is a diagram showing the structure of a fluorescent lamp drive circuit according to a second embodiment of the present invention;

FIG. 5 is a diagram showing the structure of a conventional fluorescent lamp drive circuit.

DETAILED DESCRIPTION OF THE PREFERRED EMBODIMENTS

Figure 3:
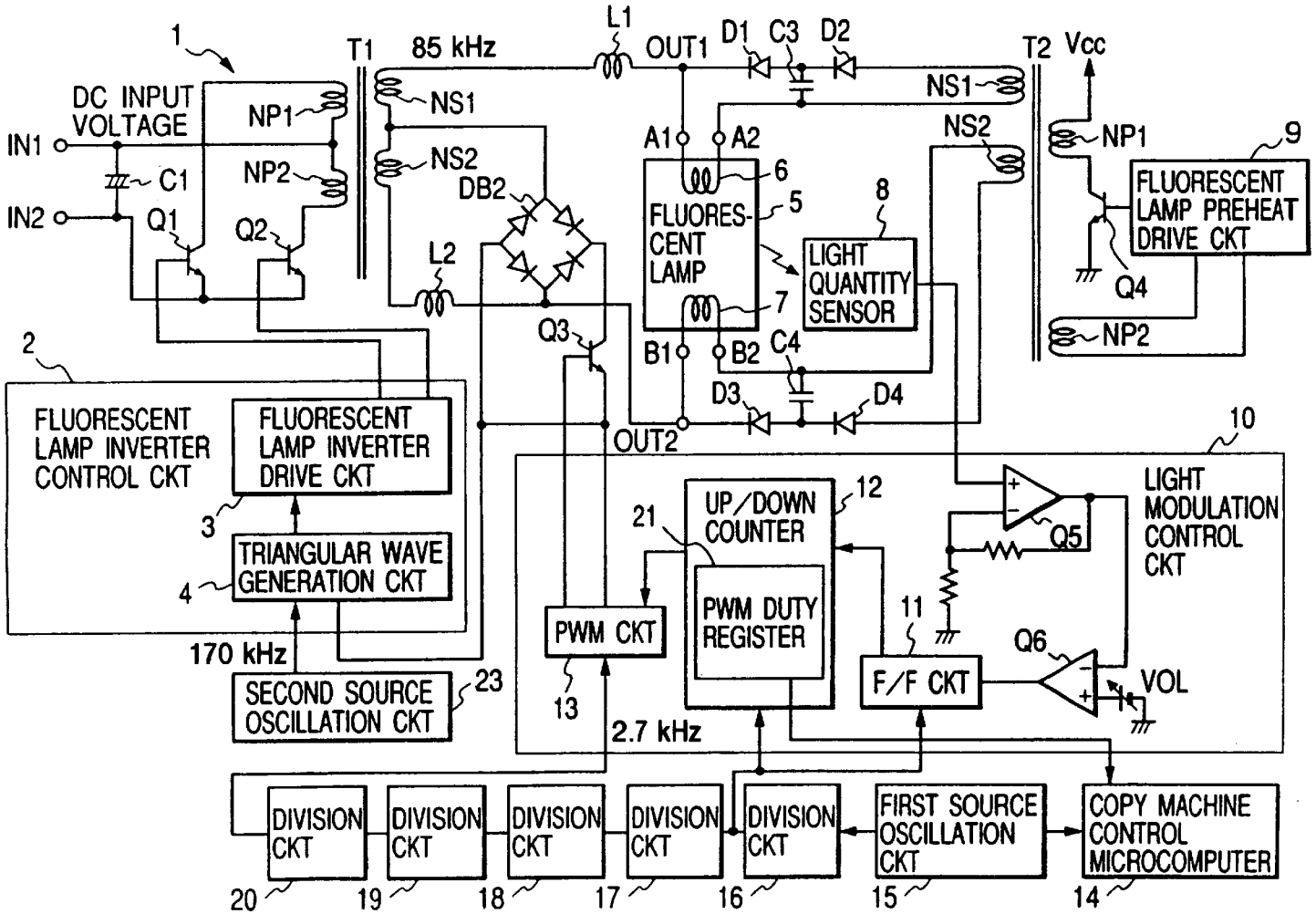
FIG. 3 is a diagram showing the structure of a fluorescent lamp drive circuit according to a third embodiment of the present invention.

Hereinafter, embodiments of the present invention will be described in detail with reference to the accompanying drawings.

(First Embodiment)

FIG. 1 is a diagram showing the structure of a fluorescent lamp drive circuit according to the first embodiment of the present invention. In the fluorescent lamp drive circuit shown in FIG. 1, the components respectively have the same functions as those of the components of the same reference numerals or symbols in the fluorescent lamp drive circuit shown in FIG. 5. In FIG. 1, the fluorescent lamp drive circuit is composed of a fluorescent lamp power supply circuit 1, a fluorescent lamp inverter control circuit 2 for controlling a fluorescent lamp inverter of the circuit 1, a fluorescent lamp 5, a light quantity sensor 8 for detecting a light quantity of the lamp 5, a preheating transformer T2 for preheating filaments 6 and 7 of the lamp 5, a light modulation control circuit 10 of the lamp 5, a copy machine control microcomputer 14 for controlling a copy machine acting as an image formation apparatus, a first source oscillation circuit 15, division circuits 16 to 20 for frequency-dividing a clock pulse generated from the circuit 15, and the like.

The fluorescent lamp drive circuit 1 is composed of a capacitor C1, a main transformer T1, a switching element (e.g., active inverter (fluorescent lamp inverter) consisting of switching transistors Q1 and Q2), choke coils L1 and L2, a diode bridge DB2, a switching transistor Q3 for controlling an output of the diode bridge DB2, and the like.

A connection point between primary windings NP1 and NP2 of the main transformer T1 is connected to an input terminal IN1, the beginning of the primary winding NP1 is connected to a collector of the switching transistor Q1, the ending of the primary winding NP2 is connected to a collector of the switching transistor Q2, each emitter of the transistors Q1 and Q2 is connected to an input terminal IN2, and each base of the transistors Q1 and Q2 is connected to a fluorescent lamp inverter drive circuit 3 of the fluorescent lamp inverter control circuit 2. Further, the electrolytic capacitor C1 is connected between the input terminals IN1 and IN2.

Two kinds of windings NS1 and NS2 are provided on a secondary side of the main transformer T1. The winding NS1 supplies a voltage necessary when the fluorescent lamp 5 is turned on, and the winding NS2 supplies a voltage necessary when the lamp 5 is initiated. The beginning of the secondary winding NS1 is connected to an output terminal OUT1 through the choke coil L1, and the ending of the secondary winding NS2 is connected to an output terminal OUT2 through the choke coil L2. Input sides of the diode bridge DB2 are connected respectively to a connection point between the secondary windings NS1 and NS2 and the output terminal OUT2. On the other hand, a plus (+) side of output sides of the diode bridge DB2 is connected to a collector of the switching transistor Q3, and a minus (−) side thereof is connected to a triangle wave generation circuit 4 of the fluorescent lamp inverter control circuit 2. An emitter and a base of the transistor Q3 is connected to a pulse width modulation (PWM) circuit 13 of the fluorescent lamp light modulation control circuit 10. Further, the emitter of the transistor Q3 is connected to the minus side of the output sides of the diode bridge DB2.

The fluorescent lamp inverter control circuit 2 is composed of the fluorescent lamp inverter drive circuit 3 and the triangular wave generation circuit 4. The fluorescent lamp inverter drive circuit 3 performs on/off controlling on the switching transistors Q1 and Q2 of the fluorescent lamp inverter. The triangular wave generation circuit 4 receives a pulse (i.e., oscillation frequency signal) of, e.g., 170 kHz from the division circuit 19. Ordinarily, the circuit 4 receives such the pulse in the form of a rectangular wave and then generates a triangular wave through, e.g., an RC filter.

One base A1 of the one-side filament 6 of the fluorescent lamp 5 is connected to the output terminal OUT1 of the fluorescent lamp power supply circuit 1, and one base B1 of the other-side filament 7 is connected to the output terminal OUT2 of the circuit 1. The light quantity sensor 8 which is composed of a photodiode and a preamplifier (both not shown) detects the light quantity of the fluorescent lamp 5 and then outputs a signal corresponding to the detected quantity.

In the preheating transformer T2, one end of a primary winding NP1 is connected to a DC power supply $V_{cc}$, and the other end is connected to a collector of a transistor Q4. An emitter of the transistor Q4 is grounded, and a base thereof is connected to a fluorescent lamp preheating drive circuit 9. Further, in the transformer T2, a preheating voltage feedback winding NP2 to control a preheating voltage applied to the filaments 6 and 7 of the lamp 5 to be a predetermined value is provided, and is connected to the fluorescent lamp preheating drive circuit 9.

One secondary winding NS1 of the preheating transformer T2 is connected to the bases A1 and A2 of the filament 6 of the lamp 5 through a rectifier circuit consisting of a diode D2 and a capacitor C3 and a reverse-current prevention diode D1. The other secondary winding NS2 is connected to the bases B1 and B2 of the filament 7 through a rectifier circuit consisting of a diode D4 and a capacitor C4 and a reverse-current prevention diode D3.

The fluorescent lamp light modulation control circuit 10 is composed of an amplifier Q5, a comparator Q6, a flip-flop circuit 11, an up/down counter 12, the PWM circuit 13 and the like. A non-inverting input terminal (+) of the amplifier Q5 is connected to the light quantity sensor 8, and an inverting input terminal (−) thereof is grounded through a resistor. An output terminal of the amplifier Q5 is connected to the inverting input terminal (−) thereof through a resistor and also connected to an inverting input terminal (−) of the comparator Q6. A setting unit, e.g., a volume VOL, for setting the light quantity of the fluorescent lamp 5 is connected to a non-inverting input terminal (+) of the comparator Q6. An output terminal of the comparator Q6 is connected to an input terminal of the flip-flop circuit 11, and an output terminal of the circuit 11 is connected to an input terminal of the up/down counter 12. The counter 12 contains therein a pulse width modulation duty (PWMDUTY) register 21. An output terminal of the counter 12 is connected to an input terminal of the PWM circuit 13, and an output terminal of the PWM circuit 13 is connected to the base of the switching transistor Q3 of the diode bridge DB2.

The copy machine control microcomputer 14 is connected to the PWMDUTY register 21. The first source oscillation circuit 15 is connected with the copy machine control microcomputer 14 and the division circuits 16 to 20. An output of the division circuit 16 is input to the PWM circuit 13, an output of the division circuit 19 is input to the triangular wave generation circuit 4, and an output of the division circuit 20 is input to the flip-flop circuit 11 and the up/down counter 12. In such the structure, for example, it is assumed that a frequency of an output pulse of the division circuit 16 is 10 MHz, a frequency of an output pulse of the division circuit 19 is 170 kHz, and a frequency of an output pulse of the division circuit 20 is 2.7 kHz.

Hereinafter, a circuit operation will be explained.

A DC input voltage supplied to the input terminals IN1 and IN2 is input to the primary windings NP1 and NP2 of the main transformer T1. Then, the input DC voltage is on/off controlled by the switching transistors Q1 and Q2 and transmitted to the secondary side of the transformer T1. The transistors Q1 and Q2 are controlled by the fluorescent lamp inverter drive circuit 3 of the fluorescent lamp inverter control circuit 2. A pulse signal (e.g., 170 kHz) output by the division circuit 19 is input to the triangular wave generation circuit 4. Ordinarily, the circuit 4 receives the input rectangular wave and generates the triangular wave through, e.g., the RC filter.

The secondary winding NS1 of the main transformer T1 supplies the voltage necessary when the fluorescent lamp 5 is turned on. On the basis of a value of the voltage at the secondary winding NS1 and a value of inductance of the choke coil L1, a value of a lighting current flowing in the filaments 6 and 7 of the lamp 5 is determined. The secondary winding NS2 supplies the voltage necessary when the lamp 5 is initiated. A voltage obtained by adding the voltages of the secondary windings NS1 and NS2 to each other is used to initialize the lamp 5. On the basis of a value of the voltage obtained by such addition and a voltage of inductance of the choke coil L2, a current flowing in the filaments 6 and 7 when the lamp 5 is initiated is determined.

The diode bridge DB2 rectifies the output voltage of the secondary winding NS1, i.e., an AC voltage applied to the filaments 6 and 7 of the lamp 5, to obtain the DC voltage. When the obtained DC voltage is on/off controlled (e.g., at frequency 2.7 kHz) by the switching transistor Q3, the current value flowing in the filaments 6 and 7 of the lamp 5 is controlled to be constant. The controlled current value becomes such a predetermined value as the value obtained by amplifying the output value of the light quantity sensor 8 through the amplifier Q5 is equal to the value set by the volume VOL and input to the non-inverting input terminal (+) of the comparator Q6.

The amplifier Q6 compares a light quantity signal of the lamp 5 input from the amplifier Q5 with the light quantity value set by the volume VOL, outputs a signal corresponding to a difference obtained by the comparison, and successively rewrites a count value of the up/down counter 12 by driving the flip-flop circuit 11. Then, according to the rewritten count value, a fluorescent lamp light modulation drive signal of a pulse waveform is generated by the PWM circuit 13. The base of the switching transistor Q3 is driven based on the fluorescent lamp light modulation drive signal to perform the on/off controlling on the rectification voltage of the diode bridge DB2. Thus, the current value flowing in the filaments 6 and 7 of the lamp 5 is controlled to perform light modulation controlling.

Since the count value of the up/down counter 12 successively rewritten by the flip-flop circuit 11 has been stored in the PWMDUTY register 21 contained in the up/down counter 12, such the value is corresponding to duty ratio of an actual lighting waveform of the lamp 5. That is, for example, if the count value is read by the copy machine control microcomputer 14, the duty ratio of the waveform currently and actually driving the lamp 5 can be known. Then, if the duty ratio is 100%, the microcomputer 14 judges that the lamp 5 has run down, and generates an alarm message to a display unit of a copy machine.

In the preheating transformer T2, the DC voltage $V_{cc}$ added to the primary winding NP1 is turned on/off by the transistor Q4 driven by the fluorescent lamp preheating drive circuit 9, and then transmitted to the secondary windings NS1 and NS2. The DC voltage is applied as the preheating voltage to both the ends of the filament 6 of the lamp 5 from the secondary winding NS1 through the diode D2, the capacitor C3 and the diode D1. Similarly, a DC voltage is applied as the preheating voltage to both the ends of the filament 7 from the secondary winding NS2 through the diode D4, the capacitor C4 and the diode D3. The primary winding NP2 detects the preheating voltage of the primary winding NP1 to feed back it to the fluorescent lamp preheating drive circuit 9. Then, in response to such a feedback signal, the circuit 9 controls the preheating voltage to have a predetermined value.

For example, the first source oscillation circuit 15 oscillates the clock pulse of 42 MHz by using a crystal oscillator. The obtained clock pulse is used as a clock pulse of the copy machine control microcomputer 14, and also input to the division circuit 16. Further, the clock pulse is appropriately frequency-divided through the division circuits 17, 18, 19 and 20. After the frequency dividing, for example, the pulse of 10 MHz frequency-divided by the division circuit 16 is input to the PWM circuit 13, the pulse of 170 kHz frequency-divided by the division circuit 19 is input to the triangular wave generation circuit 4, and the pulse of 2.7 kHz frequency-divided by the division circuit 20 is input to the flip-flop circuit 11 and the up/down counter 12.

That is, since both the pulse of the frequency 2.7 kHz (fluorescent lamp light modulation drive signal) for controlling the light modulation of the fluorescent lamp and the fluorescent lamp inverter drive signal of the frequency 85 kHz use the identical clock pulse generated by the first source oscillation circuit 15, the pulse of 2.7 kHz is completely in synchronism with the fluorescent lamp inverter drive signal of 85 kHz. It should be noted that, although the pulse received by the fluorescent lamp inverter control circuit 2 has the frequency 170 kHz, since there are the transistors Q1 and Q2 of the push-pull circuit, the current actually flowing in the filaments 6 and 7 of the lamp 5 has the frequency 85 kHz, i.e., half of the above frequency 170 kHz, whereby the fluorescent lamp inverter drive signal has the frequency 85 kHz.

Figures 6A, 6B, 6C, 6D, 6E, 6F, 6G:
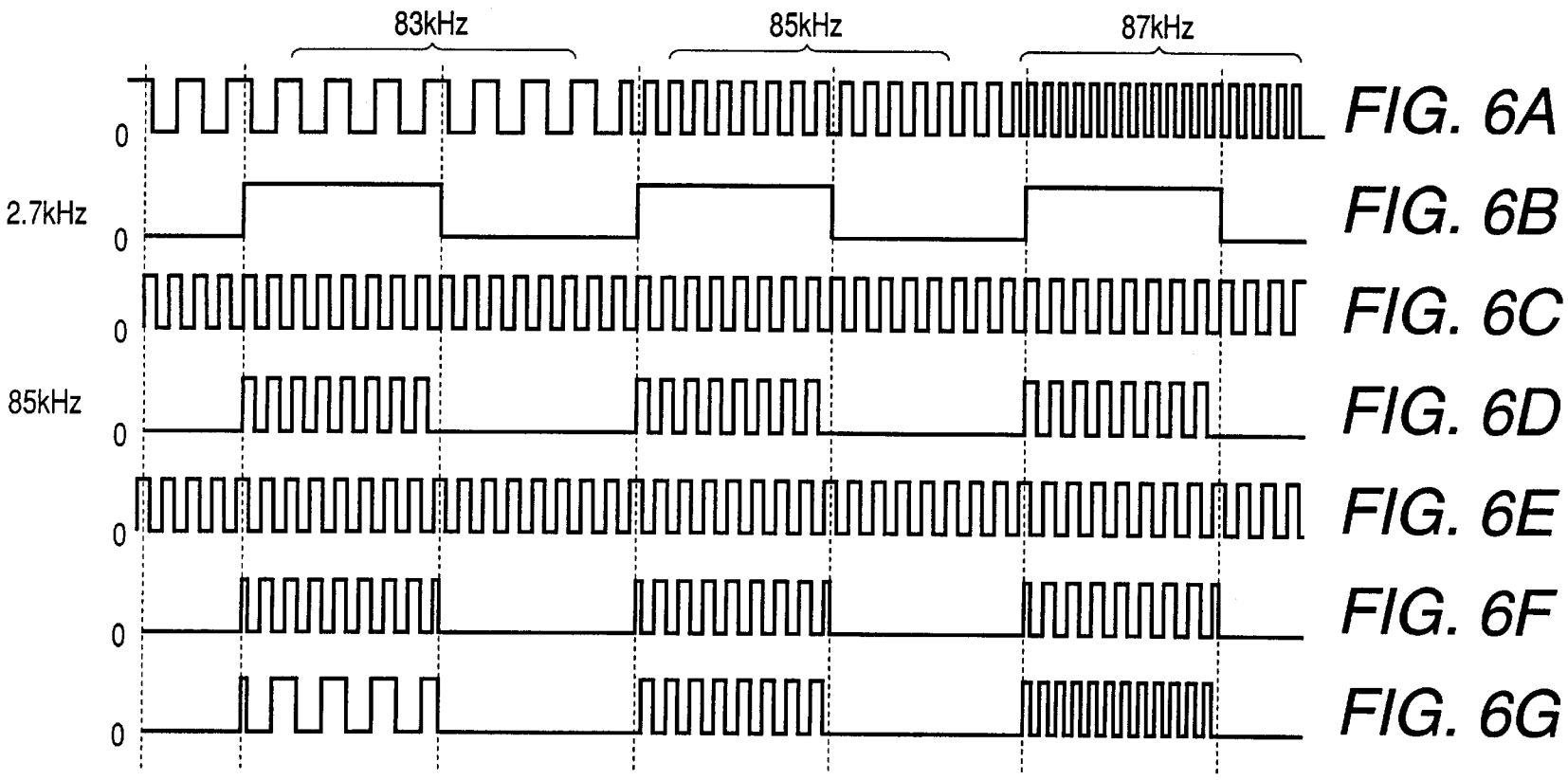
FIGS. 6A, 6B, 6C, 6D, 6E, 6F and 6G are timing charts showing signal waveforms of the conventional fluorescent lamp drive circuit shown in FIG. 5 and the fluorescent lamp drive circuit according to the present invention.

FIG. 6C shows the fluorescent lamp inverter drive signal of a frequency F in the above-described structure, and FIG.

6D shows the fluorescent lamp current waveform. In FIG. 6D, since the frequency F of the fluorescent lamp inverter drive signal is completely synchronous with a frequency f of the fluorescent lamp light modulation drive signal, any beat is not at all produced between these frequencies. As a result, any unevenness in a sub-scan direction does not appear on an image.

(Second Embodiment)

FIG. 2 is a diagram showing the structure of a fluorescent lamp drive circuit according to the second embodiment of the present invention.

The fluorescent lamp drive circuit shown in FIG. 2 is different from the fluorescent lamp drive circuit in the first embodiment only on the point that a phase-locked loop (PLL) circuit to which a fluorescent lamp light modulation drive signal of a frequency f is input and from which a fluorescent lamp inverter drive signal of a frequency F is output is used as a means for synchronizing the frequencies f and F with each other. That is, other components of the fluorescent lamp drive circuit in the present embodiment are identical with those in the first embodiment. In FIG. 2, since the components of the same reference numerals and symbols as those of the components in the first embodiment shown in FIG. 1 respectively have the same functions, explanation thereof will be omitted. An input terminal of the PLL circuit 22 is connected to an output terminal of a division circuit 20, and an output terminal of the circuit 22 is connected to an input terminal of a triangular wave generation circuit 4 of a fluorescent lamp inverter control circuit 2.

A pulse of the frequency f (2.7 kHz) output from the division circuit 20 is input to the PLL circuit 22 as the fluorescent lamp inverter drive circuit, and a pulse of the frequency F (170 kHz) is output from the circuit 22 to the fluorescent lamp inverter control circuit 2. Then, the circuit 2 performs on/off controlling on switching transistors Q1 and Q2 based on the pulse of the frequency F. In the above structure, a current waveform flowing in filaments 6 and 7 of a fluorescent lamp 5 is identical with that in the first embodiment (FIG. 6D). Thus, since the frequency F of the fluorescent lamp inverter drive signal is in synchronism with the frequency f of the fluorescent lamp light modulation drive signal, any beat is not at all produced, and therefore any unevenness in a sub-scan direction on an image does not appear.

An advantage of the fluorescent lamp drive circuit according to the second embodiment is that, when the fluorescent lamp inverter drive signal is supplied through an interface portion between the division circuit 20 and the PLL circuit 22 of the fluorescent lamp inverter control circuit 2, a frequency of this signal may be low. That is, while the frequency of the inverter drive signal in the first embodiment supplied from the division circuit 19 to the triangular wave generation circuit 4 of the fluorescent lamp inverter control circuit 2 is 170 kHz, the above-described frequency in the second embodiment is merely 2.7 kHz.

(Third Embodiment)

FIG. 3 is a diagram showing the structure of a fluorescent lamp drive circuit according to the third embodiment of the present invention.

Unlike the first and second embodiments, the fluorescent lamp drive circuit shown in FIG. 3 does not synchronize a frequency F of a fluorescent lamp inverter drive signal and a frequency f of a fluorescent lamp light modulation drive signal with each other. Instead, a high-accurate oscillation circuit is used for a fluorescent lamp inverter control circuit 2. Further, a value of the frequency F and a value of the frequency f×N (N: integer) are set to be apart from each other by a predetermined value or more (e.g., ≧500 Hz). In FIG. 3, since the components of the same reference numerals and symbols as those of the components in the first embodiment shown in FIG. 1 respectively have the same functions, explanation thereof will be omitted.

In FIG. 3, although a second source oscillation circuit 23 is not in synchronism with a first oscillation circuit 15, accuracy of the frequency F of the fluorescent lamp inverter drive signal is made high to the extent substantially identical with that of the circuit 15. A clock pulse output from the second source oscillation circuit 23 is input to a triangular wave generation circuit 4 of the fluorescent lamp inverter control circuit 2.

FIG. 6E shows the clock pulse of the second source oscillation circuit 23 in the above structure, and FIG. 6F shows a current waveform flowing in filaments 6 and 7 of a fluorescent lamp 5. In the present embodiment, the frequency F of the fluorescent lamp inverter drive signal is not in synchronism with the frequency f of the fluorescent lamp light modulation drive signal. Therefore, although a beat itself is produced, such the beat can not be seen or viewed by human eyes as unevenness in a sub-scan direction on an image.

An advantage of the fluorescent lamp drive circuit according to the third embodiment is that, since it is structured that the frequency of the fluorescent lamp inverter drive signal is not in synchronism with the frequency of the fluorescent lamp light modulation drive signal, the number of parts can be made small, thereby low cost. A further advantage is that, when the fluorescent lamp inverter drive signal is supplied through an interface portion between the second oscillation circuit 23 and the triangular wave generation circuit 4 of the fluorescent lamp inverter control circuit 2, a frequency of this signal may be low.

(Fourth Embodiment)

Figure 4:
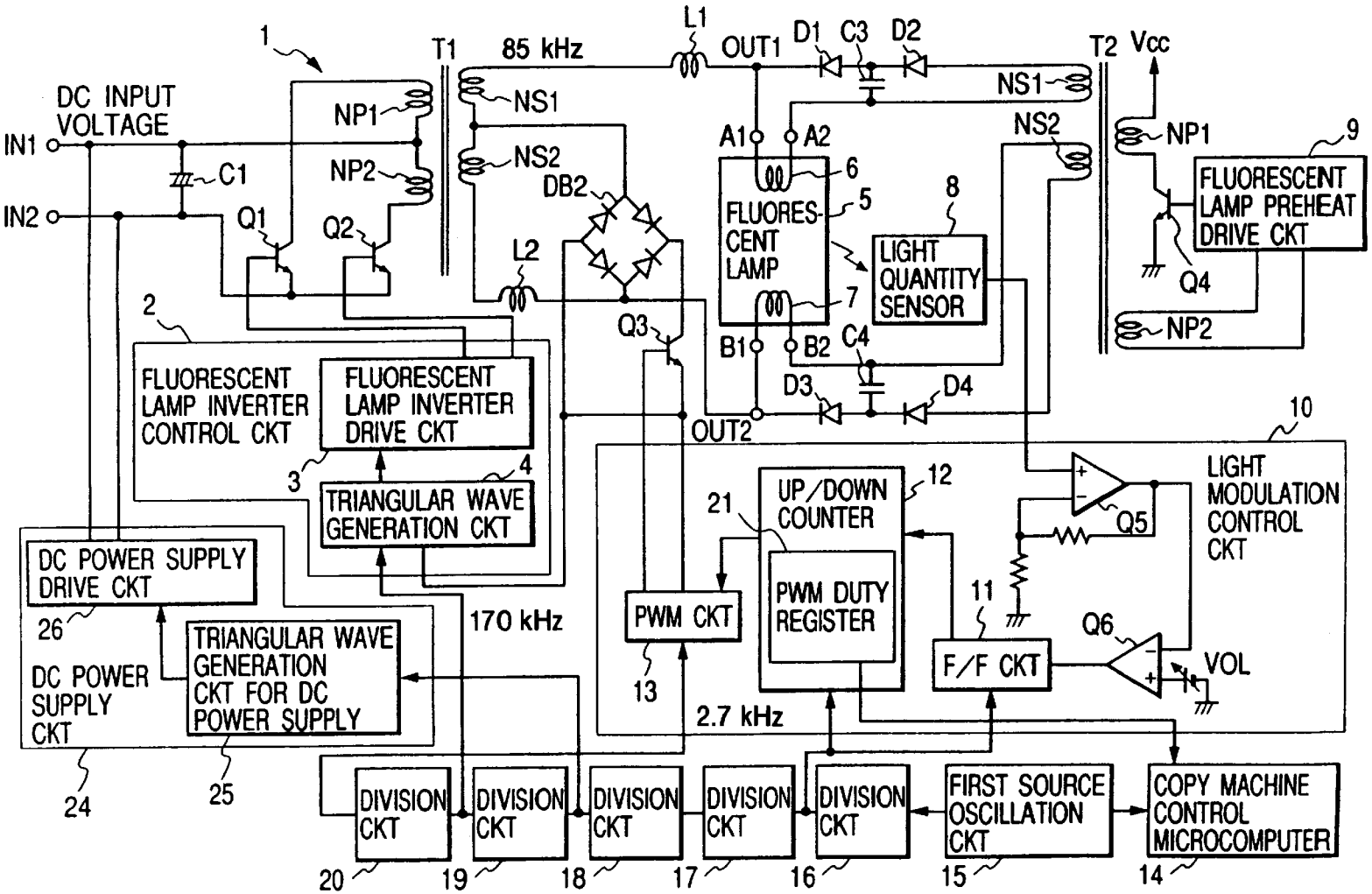
FIG. 4 is a diagram showing the entire structure of an image formation apparatus according to the present invention.

FIG. 4 is a diagram showing the entire structure of an image formation apparatus according to the present invention. In the image formation apparatus shown in FIG. 4, the fluorescent lamp drive circuit according to the first embodiment shown in FIG. 1 is used as a fluorescent lamp drive means. Therefore, since the components of the same reference numerals and symbols as those of the components in the first embodiment respectively have the same functions, explanation thereof will be omitted.

A DC power supply circuit 24 which supplies a DC voltage to a fluorescent lamp power supply circuit 1 (fluorescent lamp inverter) or a fluorescent lamp light modulation circuit 10 is composed of a DC power supply triangular wave generation circuit 25 and a DC power supply drive circuit 26. The circuit 25 is to drive the DC power supply circuit 24. Thus, a pulse output from a division circuit 18 is input to the circuit 25, and a triangular wave signal synchronous with such the input pulse is generated therefrom. The triangular wave signal from the circuit 25 is input to the drive circuit 26, and a DC voltage is supplied from the circuit 26 to input terminals IN1 and IN2.

In the above structure, from among a fluorescent lamp inverter drive signal, a fluorescent lamp light modulation drive signal and a drive signal of the DC power supply circuit 24, at least two of these three kinds of the drive signals are in synchronism with each other. Therefore, a phenomenon that a beat is produced in an input voltage of the fluorescent lamp inverter or the fluorescent lamp light modulation circuit and thus unevenness appears on an image can be eliminated in advance.

In the fourth embodiment, the drive signal for driving the power supply circuit 24 to supply a voltage to the fluorescent lamp inverter or the fluorescent lamp light modulation circuit has been explained. However, it is obvious that, in the image formation apparatus, the present embodiment can be applied to any other element or component which is driven responsive to another drive signal and is likely to produce the beat. For example, the present embodiment can be applied to a primary development unit and the like. These units include a type of an AC voltage waveform, a type of a waveform obtained by superimposing an AC waveform over a DC waveform, and the like. For this reason, there is some fear that the beat is produced due to such the waveform, and the produced beat appears on the image in one mode. However, in the present embodiment, since all the waveforms are in synchronism with others, the beat itself is not at all produced.

What is claimed is:

1. An image exposure apparatus comprising:

a transformer;

a first clock signal generation unit adapted to generate a first clock signal of a first frequency;

an inverter control circuit for outputting an inverter drive signal of the first frequency to drive a primary side of said transformer at the first frequency in accordance with the first clock signal generated by said first clock signal generation unit;

a fluorescent lamp for exposing an original;

a second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first and second clock signal generation unit is structured by a common circuit, thereby generating the first and second clock signals mutually synchronous with each other.

2. The apparatus according to claim 1, wherein said first clock signal generation unit contains a frequency division unit adapted to generate the first clock signal of the first frequency by dividing the second clock signal of the second frequency generated by said second clock signal generation unit.

3. The apparatus according to claim 1, wherein said first clock signal generation unit contains a phase-locked loop (PLL) circuit to which the second clock signal of the second frequency is input and from which the first clock signal of the first frequency is output.

4. The apparatus according to claim 1, further comprising a detection unit adapted to detect a light emission quantity of said fluorescent lamp, wherein said light modulation control circuit modulates the light modulation drive signal such that the light emission quantity detected by said detection unit becomes a target value.

5. The apparatus according to claim 1, further comprising a third clock signal generation unit adapted to generate a third clock signal of a third frequency, wherein said light modulation control circuit contains a count unit adapted to perform up/down counting of the third clock signal, and a pulse-width modulation (PWM) circuit for generating the light modulation drive signal subjected to pulse width modulation on the basis of a count value of said count unit and the second clock signal.

6. An image exposure apparatus comprising:

a first clock signal generation unit adapted to generate a first clock signal of a first frequency;

a power supply circuit for supplying a DC power voltage in accordance with the first clock signal generated by said first clock signal generation unit;

an inverter control circuit for outputting an inverter drive signal to drive a primary side of a transformer;

a fluorescent lamp for exposing an original;

second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first clock signal generation unit and said second clock signal generation unit is structured by a common circuit, thereby generating the first and second clock signals mutually synchronous with each other.

7. The apparatus according to claim 6, wherein said second clock signal generation unit contains a frequency division unit adapted to generate the second clock signal of the second frequency by dividing the first clock signal of the first frequency generated by said first clock signal generation unit.

8. The apparatus according to claim 6, further comprising:

a third clock signal generation unit adapted to generate a third clock signal of a third frequency; and an inverter control circuit for outputting an inverter drive signal of the third frequency to drive the primary side of said transformer at the third frequency in accordance with the third clock signal, wherein at least a part of said second clock signal generation unit and said third clock signal generation unit is structured by a common circuit, thereby generating the second and third clock signals mutually synchronous with each other.

9. The apparatus according to claim 6, further comprising a detection unit adapted to detect a light emission quantity of said fluorescent lamp, wherein said light modulation control circuit modulates the light modulation drive signal such that the light emission quantity detected by said detection unit becomes a target value.

10. The apparatus according to claim 6, further comprising a fourth clock signal generation unit adapted to generate a fourth clock signal of a fourth frequency, wherein said light modulation control circuit contains a count unit adapted to perform up/down counting of the fourth clock signal, and a pulse-width modulation (PWM) circuit for generating the light modulation drive signal subjected to pulse width modulation on the basis of a count value of said count unit and the second clock signal.

11. An image exposure apparatus comprising:

a fluorescent lamp driven at a first frequency F; and a light modulation control circuit for outputting a light modulation drive signal of a second frequency f to control a current flowing in said fluorescent lamp, wherein a difference $|f*N-F|$ (N: arbitrary natural number) between any integral multiple of the second frequency and the first frequency is equal to or larger than 500 Hz.

12. The apparatus according to claim 11, further comprising:

a transformer;

an inverter control circuit for outputting an inverter drive signal of the first frequency to drive a primary side of said transformer at the first frequency, wherein said light modulation control circuit is connected to a secondary side of said transformer.

13. The apparatus according to claim 12, further comprising:

a first oscillation circuit;

a frequency-dividing unit adapted to frequency-divide a clock pulse from said first oscillation circuit and for generating a clock signal of the second frequency; and a second oscillation circuit, wherein said light modulation control circuit outputs the light modulation drive signal of the second frequency based on the clock signal generated from said frequency-dividing unit, and said inverter control circuit outputs the inverter drive signal based on the clock pulse from said second oscillation circuit.

14. The apparatus according to claim 13, wherein said frequency-dividing unit contains a first dividing circuit for frequency-dividing the clock pulse from said first oscillation circuit and for generating a clock signal of a third frequency, and a second driving circuit for frequency-dividing the clock pulse from said first dividing circuit and for generating the clock signal of the second frequency, wherein said light modulation control circuit contains a count unit adapted to perform up/down counting of the clock signal of the third frequency and a pulse-width modulation (PWM) circuit for generating the light modulation drive signal subjected to pulse width modulation on the basis of a count value of said count unit and the clock signal of the second frequency.

15. The apparatus according to claim 11, further comprising a detection unit adapted to detect a light emission quantity of said fluorescent lamp, wherein said light modulation control circuit modulates the light modulation drive signal such that the light emission quantity detected by said detection unit becomes a target value.

16. A copying machine comprising:

a transformer;

a first clock signal generation unit adapted to generate a first clock signal of a first frequency;

an inverter control circuit for outputting an inverter drive signal of the first frequency to drive a primary side of said transformer at the first frequency in accordance with the first clock signal generated by said first clock signal generation unit;

a fluorescent lamp for exposing an original;

a second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first clock signal generation unit and said second clock signal generation unit is structured by a common circuit, thereby generating the first and second clock signals mutually synchronous with each other.

17. The copying machine according to claim 16, wherein said first clock signal generation unit contains a frequency division unit adapted to generate the first clock signal of the first frequency by dividing the second clock signal of the second frequency generated by said second clock signal generation unit.

18. The copying machine according to claim 16, wherein said first clock signal generation unit contains a phase-locked loop (PLL) circuit to which the second clock signal of the second frequency is input and from which the first clock signal of the first frequency is output.

19. The copying machine according to claim 16, further comprising a detection unit adapted to detect a light emission quantity of said fluorescent lamp, wherein said light modulation control circuit modulates the light modulation drive signal such that the light emission quantity detected by said detection unit becomes a target value.

20. The copying machine according to claim 16, further comprising a third clock signal generation unit adapted to generate a third clock signal of a third frequency, wherein said light modulation control circuit contains a count unit adapted to perform up/down counting of the third clock signal, and a pulse-width modulation (PWM) circuit for generating the light modulation drive signal subjected to pulse width modulation on the basis of a count value of said count unit and the second clock signal.

21. A copying machine comprising:

a first clock signal generation unit adapted to generate a first clock signal of a first frequency;

a power supply circuit for supplying a DC power voltage in accordance with the first clock signal generated by said first clock signal generation unit;

an inverter control circuit for outputting an inverter drive signal to drive a primary side of a transformer;

a fluorescent lamp for exposing an original;

a second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first clock signal generation unit and said second clock signal generation unit is structured by a common circuit, thereby generating the first and second clock signals mutually synchronous with each other.

22. The copying machine according to claim 21, wherein said second clock signal generation unit contains a frequency division unit adapted to generate the second clock signal of the second frequency by dividing the first clock signal of the first frequency generated by said first clock signal generation unit.

23. The copying machine according to claim 21, further comprising:

a third clock signal generation unit adapted to generate a third clock signal of a third frequency; and an inverter control circuit for outputting an inverter drive signal of the third frequency to drive the primary side of said transformer at the third frequency in accordance with the third clock signal, wherein at least a part of said second clock signal generation unit and said third clock signal generation unit is structured by a common circuit, thereby generating the second and third clock signals mutually synchronous with each other.

24. The copying machine according to claim 21, further comprising a detection unit adapted to detect a light emission quantity of said fluorescent lamp, wherein said light modulation control circuit modulates the light modulation drive signal such that the light emission quantity detected by said detection unit becomes a target value.

25. The copying machine according to claim 21, further comprising a fourth clock signal generation unit adapted to generate a fourth clock signal of a fourth frequency, wherein said light modulation control circuit contains a count unit adapted to perform up/down counting of the fourth clock signal, and a pulse-width modulation (PWM) circuit for generating the light modulation drive signal subjected to pulse width modulation on the basis of a count value of said count unit and the second clock signal.

26. A copying machine comprising:

a fluorescent lamp driven at a first frequency F; and a light modulation control circuit for outputting a light modulation drive signal of a second frequency f to control a current flowing in said fluorescent lamp, wherein a difference $|f*N-F|$ (N: arbitrary natural number) between any integral multiple of the second frequency and the first frequency is equal to or larger than 500 Hz.

27. The copying machine according to claim 26, further comprising:

a transformer;

an inverter control circuit for outputting an inverter drive signal of the first frequency to drive a primary side of said transformer at the first frequency, wherein said light modulation control circuit is connected to a secondary side of said transformer.

28. The copying machine according to claim 27, further comprising:

a first oscillation circuit;

a frequency-dividing unit adapted to frequency-divide a clock pulse from said first oscillation circuit and for generating a clock signal of the second frequency; and a second oscillation circuit, wherein said light modulation control circuit outputs the light modulation drive signal of the second frequency based on the clock signal generated from said frequency-dividing unit, and said inverter control circuit outputs the inverter drive signal based on the clock pulse from said second oscillation circuit.

29. The copying machine according to claim 28, wherein said frequency-dividing unit contains a first dividing circuit for frequency-dividing the clock pulse from said first oscillation circuit and for generating a clock signal of a third frequency, and a second driving circuit for frequency-dividing the clock pulse from said first dividing circuit and for generating the clock signal of the second frequency, wherein said light modulation control circuit contains a count unit adapted to perform up/down counting of the clock signal of the third frequency, and a pulse-width modulation (PWM) circuit for generating the light modulation drive signal subjected to pulse width modulation on the basis of a count value of said count unit and the clock signal of the second frequency.

30. The copying machine according to claim 26, further comprising a detection unit adapted to detect a light emission quantity of said fluorescent lamp, wherein said light modulation control circuit modulates the light modulation drive signal such that the light emission quantity detected by said detection unit becomes a target value.

31. A fluorescent lamp driving apparatus comprising:

a transformer;

a first clock signal generation unit adapted to generate a first clock signal of a first frequency;

an inverter control circuit for outputting an inverter drive signal of the first frequency to drive a primary side of said transformer at the first frequency in accordance with the first clock signal generated by said first clock signal generation unit;

a fluorescent lamp;

a second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first clock signal generation unit and said second clock signal generation unit is structured by a common circuit, thereby generating the first and second clock signals mutually synchronous with each other.

32. The apparatus according to claim 31, wherein said first clock signal generation unit contains a frequency division unit adapted to generate the first clock signal of the first frequency by dividing the second clock signal of the second frequency generated by said second clock signal generation unit.

33. The apparatus according to claim 31, wherein said first clock signal generation unit contains a phase-locked loop (PLL) circuit to which the second clock signal of the second frequency is input and from which the first clock signal of the first frequency is output.

34. The apparatus according to claim 31, further comprising a detection unit adapted to detect a light emission quantity of said fluorescent lamp, wherein said light modulation control circuit modulates the light modulation drive signal such that the light emission quantity detected by said detection unit becomes a target value.

35. The apparatus according to claim 31, further comprising a third clock signal generation unit adapted to generate a third clock signal of a third frequency, wherein said light modulation control circuit contains a count unit adapted to perform up/down counting of the third clock signal, and a pulse-width modulation (PWM) circuit for generating the light modulation drive signal subjected to pulse width modulation on the basis of a count value of said count unit and the second clock signal.

36. A fluorescent lamp driving apparatus comprising:

a first clock signal generation unit adapted to generate a first clock signal of a first frequency;

a power supply circuit for supplying a DC power voltage in accordance with the first clock signal generated by said first clock signal generation unit;

an inverter control circuit for outputting an inverter drive signal to drive a primary side of a transformer;

a fluorescent lamp;

a second clock signal generation unit adapted to generate a second clock signal of a second frequency; and a light modulation control circuit, connected to a secondary side of said transformer, for outputting a light modulation drive signal of the second frequency to control a current flowing in said fluorescent lamp in accordance with the second clock signal, wherein, although the first and second clock signals are supplied respectively to circuits of different sides of said transformer, at least a part of said first clock signal generation unit and said second clock signal generation unit is structured by a common circuit, thereby generating the first and second clock signals mutually synchronous with each other.

37. The apparatus according to claim 36, wherein said second clock signal generation unit contains a frequency division unit adapted to generate the second clock signal of the second frequency by dividing the first clock signal of the first frequency generated by said first clock signal generation unit.

38. The apparatus according to claim 36, further comprising:

a third clock signal generation unit adapted to generate a third clock signal of a third frequency; and an inverter control circuit for outputting an inverter drive signal of the third frequency to drive the primary side of said transformer at the third frequency in accordance with the third clock signal, wherein at least a part of said second clock signal generation unit and said third clock signal generation unit is structured by a common circuit, thereby generating the second and third clock signals mutually synchronous with each other.

39. The apparatus according to claim 36, further comprising a detection unit adapted to detect a light emission quantity of said fluorescent lamp, wherein said light modulation control circuit modulates the light modulation drive signal such that the light emission quantity detected by said detection unit becomes a target value.

40. The apparatus according to claim 36, further comprising a fourth clock signal generation unit adapted to generate a fourth clock signal of a fourth frequency, wherein said light modulation control circuit contains a count unit adapted to perform up/down counting of the fourth clock signal, and a pulse-width modulation (PWM) circuit for generating the light modulation drive signal subjected to pulse width modulation on the basis of a count value of said count unit and the second clock signal.

41. A fluorescent lamp driving apparatus comprising:

a fluorescent lamp driven at a first frequency F; and a light modulation control circuit for outputting a light modulation drive signal of a second frequency f to control a current flowing in said fluorescent lamp, wherein a difference $|f*N-F|$ (N: arbitrary natural number) between any integral multiple of the second frequency and the first frequency is equal to or larger than 500 Hz.

42. The apparatus according to claim 41, further comprising:

a transformer;

an inverter control circuit for outputting an inverter drive signal of the first frequency to drive a primary side of said transformer at the first frequency, wherein said light modulation control circuit is connected to a secondary side of said transformer.

43. The apparatus according to claim 42, further comprising:

a first oscillation circuit;

a frequency-dividing unit adapted to frequency-divide a clock pulse from said first oscillation circuit and for generating a clock signal of the second frequency; and a second oscillation circuit, wherein said light modulation control circuit outputs the light modulation drive signal of the second frequency based on the clock signal generated from said frequency-dividing unit, and said inverter control circuit outputs the inverter drive signal based on the clock pulse from said second oscillation circuit.

44. The apparatus according to claim 43, wherein said frequency-dividing unit contains a first dividing circuit for frequency-dividing the clock pulse from said first oscillation circuit and for generating a clock signal of a third frequency, and a second driving circuit for frequency-dividing the clock pulse from said first dividing circuit and for generating the clock signal of the second frequency, wherein said light modulation control circuit contains a count unit adapted to perform up/down counting of the clock signal of the third frequency, and a pulse-width modulation (PWM) circuit for generating the light modulation drive signal subjected to pulse width modulation on the basis of a count value of said count unit and the clock signal of the second frequency.

45. The apparatus according to claim 41, further comprising a detection unit adapted to detect a light emission quantity of said fluorescent lamp, wherein said light modulation control circuit modulates the light modulation drive signal such that the light emission quantity detected by said detection unit becomes a target value.

* * * * *

UNITED STATES PATENT AND TRADEMARK OFFICE

CERTIFICATE OF CORRECTION

PATENT NO. : 6,225,751 B1
DATED : May 1, 2001
INVENTOR(S) : Shunichi Komatsu

It is certified that error appears in the above-identified patent and that said Letters Patent is hereby corrected as shown below:

Column 2,
Line 35, "unevenness/of" should read -- unevenness of --; and
Line 60, "An another" should read -- another --.

Column 6,
Line 34, "back it" should read -- it back --.

Column 11,
Line 3, "transformer;" should read -- transformer; and --.

Column 13,
Line 37, "transformer;" should read -- transformer; and --.

Column 16,
Line 13, "transformer;" should read -- transformer; and --.

Signed and Sealed this

Fifth Day of March, 2002

*Attest:*

*Attesting Officer*

JAMES E. ROGAN
*Director of the United States Patent and Trademark Office*